US008221130B2

(12) United States Patent
Krongard et al.

(10) Patent No.: US 8,221,130 B2
(45) **Date of Patent: *Jul. 17, 2012**

(54) ADHESIVE-BACKED CHALKBOARD WALL COVERING

(75) Inventors: Allison T. Krongard, East Hampton, NY (US); John A. Boris, Neenah, WI (US)

(73) Assignee: WallCandy LLC, East Hampton, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/983,455

(22) Filed: Jan. 3, 2011

(65) Prior Publication Data

US 2011/0104655 A1 May 5, 2011

Related U.S. Application Data

(63) Continuation of application No. 11/786,303, filed on Apr. 11, 2007, now Pat. No. 7,878,812.

(60) Provisional application No. 60/811,915, filed on Jun. 8, 2006.

(51) Int. Cl.
*B43L 1/00* (2006.01)

(52) U.S. Cl. ..... 434/408

(58) Field of Classification Search ..... 434/247, 434/408, 413, 416, 421, 425; 428/40.1, 41.4, 428/41.8, 32.1, 32.14, 32.18, 32.31
See application file for complete search history.

(56) References Cited

U.S. PATENT DOCUMENTS

| | | | | | |
|---|---|---|---|---|---|
| 3,486,246 | A * | 12/1969 | Johnson, Jr. | 434/425 |
| 3,497,969 | A * | 3/1970 | Schwoegler | 434/425 |
| 3,642,562 | A * | 2/1972 | Kawaguchi | 442/72 |
| 4,138,523 | A * | 2/1979 | Katsurayama et al. | 428/216 |
| 4,242,396 | A * | 12/1980 | Wilson et al. | 428/141 |
| 4,940,628 | A * | 7/1990 | Lin et al. | 428/207 |
| 4,978,568 | A * | 12/1990 | Postma | 428/192 |
| 5,024,898 | A * | 6/1991 | Pitts et al. | 428/511 |
| 5,622,504 | A * | 4/1997 | Hance | 434/430 |
| 6,464,507 | B1 * | 10/2002 | Bailey | 434/247 |
| 7,399,184 | B2 * | 7/2008 | Hester et al. | 434/408 |
| 2003/0118972 | A1 * | 6/2003 | Green | 434/81 |
| 2004/0091849 | A1 * | 5/2004 | Gallant et al. | 434/408 |
| 2005/0079473 | A1 * | 4/2005 | Smith et al. | 434/162 |

* cited by examiner

*Primary Examiner* — Kurt Fernstrom
(74) *Attorney, Agent, or Firm* — Cozen O'Connor

(57) ABSTRACT

An improved chalkboard marking surface comprises a rollable, flexible sheet of polypropylene having two sides that are opposite one another, each having a generally flat surface. On one side, a layer of adhesive is applied to the polypropylene substrate. On the same side of the polypropylene substrate, a selectively removable release sheet is preferably applied to the layer of adhesive for the purpose of keeping foreign materials from attaching to the adhesive when the chalkboard surface is not in use. On the reverse side of the polypropylene substrate, a layer of ink is applied which forms an abrasive surface after it dries, and importantly, results in a chalkboard surface that is lighter in weight.

19 Claims, 1 Drawing Sheet

FIG. 1
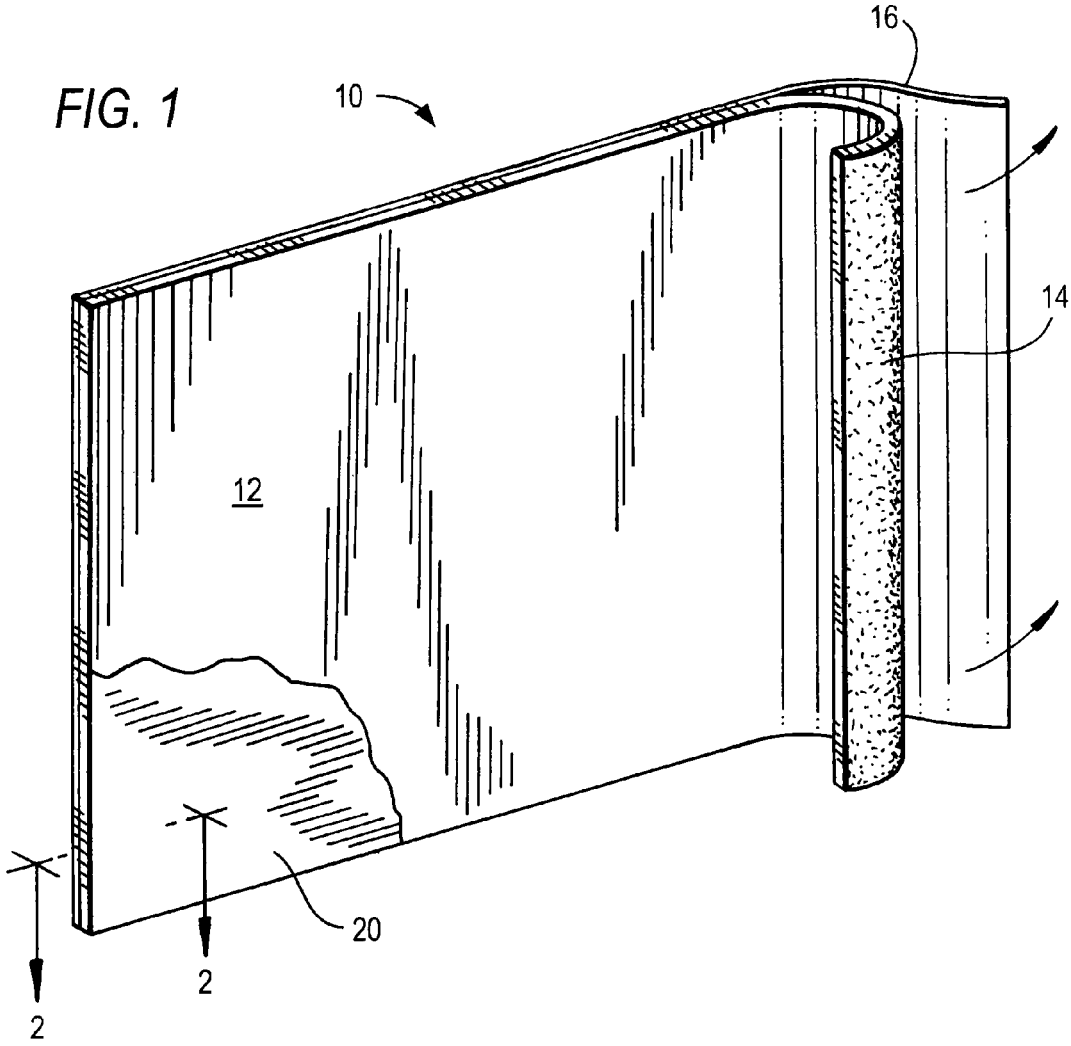
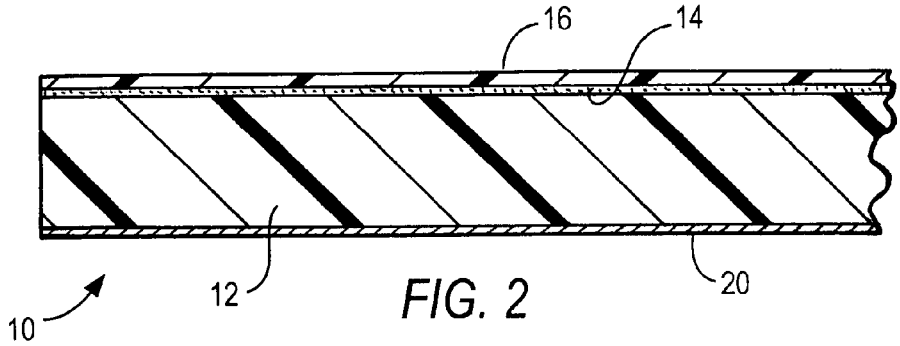
FIG. 2

ADHESIVE-BACKED CHALKBOARD WALL COVERING

REFERENCE TO RELATED APPLICATIONS

This application is a continuation of U.S. patent application Ser. No. 11/786,303, filed Apr. 11, 2007, now U.S. Pat. No. 7,878,812 the disclosure of which, in its entirety, is incorporated herein by reference, and which claimed the benefit under 35 U.S.C. §119(e) of prior co-pending U.S. Provisional Patent Application Ser. No. 60/811,915, filed Jun. 8, 2006.

FIELD OF THE INVENTION

This invention relates generally to a surface for writing, drawing or displaying any visual indicia. More particularly, this invention involves an improved surface for writing and/or drawing with chalk and other suitable instruments. Even more specifically, this invention relates to a selectively removable and flexible chalkboard surface that is relatively lighter in weight as compared to prior art chalkboard surfaces.

BACKGROUND OF THE INVENTION

Conventional slate chalkboards used in teaching environments to convey written messages and to display graphic and other visual elements have been a staple in elementary schools and high schools for a very long period of time. For many, chalkboards are also utilized in universities and, in some cases, continue to be a part of people's lives even when they continue to a work environment.

When introduced, chalkboards were generally boards of dark slate that were marked with shards of light slate. Over the years, chalkboards progressed and chalk was used in place of slate shards to write on the board. Further developments in this arena included the use of more durable slate, as well as magnetic chalkboards, which accept magnetic visual aids for teaching purposes. These types of chalkboards are generally made of porcelain on a steel magnetic surface that comes in two easily recognized colors—green and black.

In addition to the foregoing, chalkboards have evolved in other ways by providing for a removable and portable "chalkboard-esqe" surface having properties that allow a user to delineate a chalk mark thereon. For example, U.S. Pat. No. 3,497,969 ("Schwoegler") teaches a flexible, rollable chalkboard surface. Schwoegler discloses a number of different sheet materials that can be used in connection with the chalkboard surface, including both natural and synthetic materials, such as paper laminates, acetate butyrate, polyvinyl chloride, polyethylene, polypropylene etc. Generally, the chalkboard surface is formed by coating one side of the sheet material with a pigmented coating composition that includes a black or gray pigmented rubber latex paint and a finely divided, mildly abrasive material. Other resinous or plastic materials may be used as well in combination with the mildly abrasive material. A coating of pressure sensitive adhesive is applied to the second side of the sheet material. Releasably attached to the pressure sensitive adhesive coating is a protective sheet which, upon removal, permits the flexible, rollable chalkboard to be mounted on a supporting surface, such as a wall. The chalkboard surface is also removable from the supporting surface after it is attached, and may be stored for later use.

U.S. Pat. No. 4,138,523 ("Katsurayama") likewise discloses a film material for forming blackboards. The film material comprises polypropylene or polyethylene covered on one surface with a layer of paint, made of polyurethane resin composed of polyol and polyisocyanate. The paint contains a coloring pigment, a bulking agent, such as powdered alumina and powdered calcium carbonate, and in some cases silicon oil or polyethylene wax. Katsurayama discloses that the film is attached to a base board, such as a wooden board, a veneer board, a particle board or fiber board, by means of a conventional plastics adhesive, with the paint layer exposed on the outside.

Although the flexible varieties of prior art chalkboard surfaces appear to have certain advantages, they suffer from at least one major deficiency. In particular, the chalkboard surfaces disclosed by Schwoegler and Katsurayama utilize various types of paint (rubber latex paint in the case of Schwoegler, and polyurethane resin in the case of Katsurayama) in combination with other mildly abrasive materials to form an abrasive layer that enables a user to write on the surface with chalk. Use of a thick and relatively heavy paint in the formation of such flexible chalkboard surfaces adds unwanted weight to the finished product. After being adhesively attached to a supportive surface, the added weight typically causes such flexible chalkboard surfaces to slowly disengage themselves from the supportive surface, even without a user attempting to remove the chalkboard surface from the supportive backing. This is particularly problematic when a chalkboard surface (attached to a wall, door or other form of supportive surface) is vertically oriented, as is customary when writing or displaying messages or other visual indicia.

SUMMARY OF THE PRESENT INVENTION

In view of the prior art deficiencies, it is a primary object of the present invention to provide a selectively removable and flexible chalkboard marking surface or covering that is relatively lighter in weight as compared to prior art chalkboard surfaces (having equivalent surface areas for marking and other comparable features that affect weight).

Another related object of the present invention is provide a selectively removable and flexible chalkboard marking surface that tends to remain joined to a supportive surface, such as a door, wall or other generally flat surface, unless otherwise acted upon by an external force applied by a user.

Additional objectives will be apparent from the description of the invention that follows.

In its broadest aspects, the invention involves an improved surface which accepts chalk for writing, drawing and the like. In a preferred embodiment of the present invention, the chalkboard surface comprises a rollable, flexible sheet of polypropylene having two sides that are opposite one another, each having a generally flat surface. On one side, an adhesive is applied to the polypropylene substrate. On the same side of the polypropylene substrate, a selectively removable release sheet is preferably applied to the adhesive for the purpose of keeping foreign materials from attaching to the adhesive when the chalkboard surface is not in use. On the reverse side of the polypropylene substrate, an ink is applied which forms an abrasive exterior after it dries, and importantly, results in a chalkboard surface that is lighter in weight, with all other aspects of the chalkboard surface being equal.

BRIEF DESCRIPTIONS OF THE DRAWINGS

With reference to the figures,

FIG. 1 is a perspective view of a preferred embodiment of the inventive chalkboard marking surface;

FIG. 2 is a cross section of the inventive chalkboard marking surface taken substantially along lines 2-2 of FIG. 1.

DETAILED DESCRIPTION OF THE PRESENT INVENTION

With reference to the figures, FIG. 1 depicts a preferred embodiment of the inventive chalkboard marking surface 10. The chalkboard marking surface 10 comprises a rollable, flexible sheet of polypropylene 12 as a substrate. The polypropylene substrate that is preferably employed in connection with the present invention is that marketed under the trademark VinyLike by DCM, Inc. of Cincinnati, Ohio. This material is described as a high yield, 2-sided matte finished, high opacity mineral enhanced printing and converting film. In a preferred embodiment, a VinyLike polypropylene sheet having a thickness of approximately 6 mil is utilized, although sheets of other thicknesses (e.g., 3.2 mil) may be utilized instead. Other natural and/or synthetic substrates that are well known in the art, including vinyl and other types of polypropylene, may be used as well.

On one side (i.e., the back side) of the polypropylene substrate sheet 12, a layer of adhesive 14 is applied. Alternatively, the adhesive 14 may be pre-applied to the substrate sheet 12 rather than independently applied. The adhesive 14 is preferably a conventional very low-tack, pressure sensitive adhesive that is commercially available, which allows the inventive chalkboard surface to attach and detach easily from a flat surface at the discretion of a user without damaging the surface to which it attaches. In the context of the present invention a smooth, even layer of adhesive 14 is applied to the polypropylene substrate sheet 12, however, it should be understood that a non-even layer of adhesive may be applied, where more adhesive is applied at the corners and/or at the center of the polypropylene sheet than in other areas, or where adhesive is applied at the corners and/or at the center of the polypropylene sheet, but none is applied elsewhere. Selectively applying adhesive in such designated areas rather than across the entire back side of the polypropylene sheet further assists in keeping the total weight of the chalkboard surface 10 down to a desired level. The DCM VinyLike product mentioned as the preferred polypropylene substrate is manufactured with an acceptable adhesive layer which is pre-applied to the back side of the substrate.

On the same back side of the polypropylene substrate 12, a selectively removable, protective, paper-based, silicone backing release sheet or liner 16 is applied to the adhesive layer 14 to prevent the adhesive layer 14 from attaching to other surfaces in an unwanted fashion and/or to prevent foreign materials from attaching to the adhesive layer 14, when the chalkboard surface 10 is not in use or is placed in storage. In applying the chalkboard surface 10 to a door, for example, a user first peels the liner 16 away from the adhesive layer 14, then places the chalkboard surface 10 against a door, and then manually smoothes the chalkboard surface 10 so that it is flat against the door. The DCM VinyLike product mentioned as the preferred polypropylene substrate is manufactured with an acceptable release liner layer which is pre-applied to the adhesive layer.

On the reverse side (i.e., the front side) of the polypropylene substrate, at least one coat of ink 20 is applied, which forms an abrasive exterior after it dries, and importantly, results in a chalkboard surface 10 that is lighter in weight, with all other aspects of the chalkboard surface 10 being equal (i.e., type and dimension of substrate, release liner and adhesive). In a preferred embodiment, a single coat of ink 20 is sufficient to provide for a desirably coarse surface suitable for use with chalk. When utilizing ink 20, the chalkboard surface 10 remains attached to a wall for a much greater period of time than a similar final product made with paint, which typically falls off the wall from its own weight relatively quickly. Further, even after the initial use (and subsequent uses), the chalkboard surface 10 may be removed and then re-applied to a wall or other suitable surface for later use.

In a preferred embodiment, the ink 20 utilized in connection with the invention is a combination of UV Stampable Matte Varnish and a pigment or dye such as that marketed under the trade name Sinvacure UV IMP #50 Black (or other similarly colored dye or pigment), both available through the Flint Group of Ann Arbor, Mich. Most preferably, the ink layer 20 is formed by combining the UV Stampable Matte Varnish and the Sinvacure UV IMP #50 Black in a ratio of about 4 to 1, such that the ink composition comprises approximately 80% of the UV Stampable Matte Varnish and approximately 20% of the Sinvacure UV IMP #50 Black. In forming the chalkboard ink 20, no other additives are required. In particular, aside from the ingredients described herein, the ink 20 does not require adding of mildly abrasive materials, resinous or plastic materials or bulking agents as used in conjunction with prior art devices.

It should be understood, that other dyes or pigments instead of the Sinvacure UV IMP #50 Black may be employed to change the color of the ink that is used. Even when another dye or pigment is used, the UV Stampable Matte Varnish should remain constant, although relative ratios may change somewhat. In connection with the foregoing, traditional shades of green or grey may be used. Likewise, lighter colors, including light shades of pink, yellow and even white (preferably for use with colored chalk), may be prepared by replacing the Sinvacure UV IMP #50 Black, or the like, with another appropriately colored dye or pigment, or combination thereof.

After the ink 20 dries, the coating is approximately 1 mm thick (or less). The resulting surface has a dull, matte finish which is abrasive, allowing the surface to receive and to erasably retain markings made with conventional chalk. The applications of this product range from regular walls, doors, tables, children's rooms, kitchens, play areas, home offices, or wherever else one might find a chalkboard marking surface to be useful.

The advantages of the present invention, particularly, the lesser relative weight of the inventive chalkboard surface 10, are readily apparent from the following experiment which was performed to compare the present invention with other products that are available on the market and are representative of the prior art. In the experiment, a layer of conventional chalkboard paint sold under the trademark Benjamin Moore Studio Finishes™ chalkboard paint (307) was applied to a sample section of DCM VinylLike polypropylene substrate. When the chalkboard paint was applied, it did not properly adhere to the VinylLike surface, receding instead and forming a light-gray film. To form a grittier surface to which the chalkboard paint could properly adhere, an intermediate layer of primer was applied with a roller to the vinyl, as suggested by a paint specialist. Although the primer was required for the chalkboard paint to adhere, it added significantly to the overall weight of the marking surface. Once the primer was applied, the surface began to noticeably curl at its edges due to the weight and thickness of the primer. After the primer dried, the chalkboard paint was evenly applied to the primed surface. A 19"×19" section of the primer-paint treated surface was removed and compared to a section of the inventive chalkboard marking surface 10 which was formed from the same VinylLike substrate 12.

Thus, the only significant difference between the marking surface 10 of the present invention and the experimental surface created for comparison purposes was the use of the ink 20 versus use of the primer-paint combination. The sample coated with primer and chalkboard paint weighed 101.3 grams, while the inventive chalkboard marking surface 10 weighed only 55.8 grams. Once the primer-paint treated surface was applied to a vertical wall, it became detached from the wall within about 15 minutes. Contrastingly, the inventive chalkboard marking surface, having the same amount of adhesive, tightly clung to the wall until it was manually removed (i.e., it remained attached indefinitely). Of course, additional adhesive may be utilized to retain additional weight. However, it is desirable to use only as little or as much adhesive as is necessary so that the failure rate is only about a 1% (or less). "Failure" should be understood to include various situations where the marking surface 10 does not adhere as intended. These situations include those where the marking surface 10 strips paint from, for example, a wall to which it is applied when the surface 10 is removed, or where the marking surface 10 becomes detached from a wall due to its own weight.

Although the invention has been described with reference to particular embodiments, it is to be understood that these are merely illustrative of the application of the principles of the invention. Thus, it is to be understood that numerous modifications may be made in the invention and other arrangements may be devised without departing from the spirit and scope of the invention.

The invention claimed is:

1. A chalk marking surface suitable for mounting on a substantially vertical surface comprising:

a substrate having a first side and a second side, each of said first side and said second side being generally flat;

a layer of adhesive applied on said first side and adapted for selective repeated attachment of said chalk marking surface to said vertical surface and for selective repeated detachment of said chalk marking surface from said vertical surface without any substantial resulting damage to said vertical surface; and wherein said second side comprises at least one coating of ink comprising a matte finish for accepting chalk marks and, optionally, a dye or pigment.

2. The chalk marking surface of claim 1, said substrate comprising polypropylene adapted to retain said ink.

3. The chalk marking surface of claim 1, said substrate comprising vinyl adapted to retain said ink.

4. The chalk marking surface of claim 1, further comprising a selectively removable liner applied on said adhesive layer for preventing foreign materials from attaching to said adhesive layer.

5. The chalk marking surface of claim 4, said liner comprising a paper-based material.

6. The chalk marking surface of claim 4, said liner comprising silicone.

7. The chalk marking surface of claim 1, said coating of ink comprising a matte varnish mixed with a colored dye.

8. The chalk marking surface of claim 7, said matte varnish being UV Stampable Matte Varnish.

9. The chalk marking surface of claim 7, said colored dye comprising Sinvacure UV IMP #50 Black.

10. The chalk marking surface of claim 1, said coating of ink comprising a matte varnish and a pigment or dye in a ratio of about 4:1, respectively.

11. The chalk marking surface of claim 1, said substrate being rollable and flexible.

12. A marking surface comprising:

a section of polypropylene having a first side and a second side, each of said first side and said second side being generally flat;

a layer of adhesive applied on said first side, said layer of adhesive being adapted to releasably secure said marking surface in a selectively repetitive fashion to a substantially vertical wall without any substantial resulting damage to said wall; and wherein at least one coating of ink is applied on said second side, said ink comprising a matte varnish, and, optionally, a pigment or dye, and forming an abrasive matte finish for retaining chalk markings on said surface.

13. The surface of claim 12, said section of polypropylene being rollable and flexible.

14. The surface of claim 12, further comprising a release sheet disposed on said layer of adhesive, said release sheet being selectively removable from and re-attachable to said layer of adhesive.

15. The surface of claim 12, said ink comprising UV Stampable Matte Varnish and Sinvacure UV IMP #50 Black.

16. The surface of claim 12, said ink comprising a matte varnish and a pigment or dye being combined in a ratio of about 4:1, respectively.

17. A chalk marking surface suitable for mounting on a substantially vertical surface comprising:

a substrate having a first side and a second side, each of said first side and said second side being generally flat;

a layer of adhesive applied on said first side and adapted for selective repeated attachment of said chalk marking surface to said vertical surface and for selective repeated detachment of said chalk marking surface from said vertical surface without any substantial resulting damage to said vertical surface; and said second side comprising at least two coatings of ink and said coatings of ink forming an abrasive exterior when dry for accepting chalk marks.

18. A chalk marking surface of claim 17, said ink comprising a matte varnish and a colored dye or pigment.

19. A chalk marking surface of claim 17, said coatings of ink comprising a first coating of ink comprising a colored dye or pigment and a second coating of ink applied on top of said first coating and forming an abrasive matte finish for retaining chalk markings on said surface.

* * * * *